United States Patent [19]

Scherer

[11] Patent Number: 4,665,968

[45] Date of Patent: May 19, 1987

[54] CASTING MOLD WITH FEEDER

[75] Inventor: Manfred Scherer, Lohr/Main, Fed. Rep. of Germany

[73] Assignee: Mannesmann Rexroth GmbH, Jahnstrasse, Fed. Rep. of Germany

[21] Appl. No.: 734,184

[22] Filed: May 15, 1985

[30] Foreign Application Priority Data

May 16, 1984 [DE] Fed. Rep. of Germany ..... 3418137

[51] Int. Cl.[4] ..... B22C 9/02

[52] U.S. Cl. ..... 164/360; 164/53

[58] Field of Search ..... 164/359, 360, 53

[56] References Cited

FOREIGN PATENT DOCUMENTS

| | | | |
|---|---|---|---|
| 2803247 | 7/1979 | Fed. Rep. of Germany | 164/360 |
| 2822437 | 11/1979 | Fed. Rep. of Germany | 164/360 |
| 3110535 | 11/1982 | Fed. Rep. of Germany . | |
| 1504965 | 10/1967 | France | 164/360 |
| 44-20726 | 9/1969 | Japan | 164/360 |

OTHER PUBLICATIONS

Brochure of G. L. Rexroth GmbH entitled "Highly Exothermal Feed GS,GG,GGG and GT".

*Primary Examiner*—Kuang Y. Lin

*Attorney, Agent, or Firm*—Roylance, Abrams, Berdo & Goodman

[57] ABSTRACT

A casting mold with a feeder, particularly for producing cast iron, includes an exothermically heated feeder mass. The casting material in the cylindrical or slightly conical feeder volume of the feeder mass is kept in a liquid state until termination of the drawing in of casting material by suction into the casting cavity. The feeder volume has dimensions corresponding to the quantity of casting material drawn into the mold cavity to compensate for casting shrinkage, plus a miximum security allowance of 30 percent of the quantity of casting material drawn in. To obtain a feeder mass which is less costly than conventional feeder masses, from the point of view of simpler and more propitious temperature measurements, the feeder mass has an outside shape of a flattened sphere, a flattened ellipsoid or a flattened pear. The smallest diameter is on the side away from the casting being produced. The flattening is provided adjacent to the casting.

15 Claims, 3 Drawing Figures

CASTING MOLD WITH FEEDER

FIELD OF THE INVENTION

The present invention relates to a casting mold with a feeder, particularly for iron castings, wherein an exothermically heated mass surrounds the feeder volume.

BACKGROUND OF THE INVENTION

A conventional mold has a feeder volume surrounded by an exothermically heated mass configured as a truncated cone or truncated pyramid. Two surfaces on the wide sides are placed opposite each other, forming an angle. The mass is designed to be arched on the two small sides. The feeder mass has its largest wall thickness in transverse cross section located remote from the metal which is being cast in the mold cavity. An example of this arrangement is disclosed in German Offenlegungshrift DE-OS No. 31 10 535.

Another conventional casting mold with a feeder has a feeder mass configured essentially as a truncated cone. The top and bottom ends of the cone are tapered toward the ends. The larger wall thickness in transverse cross section of the truncated cone is generally adjacent to the casting.

SUMMARY OF THE INVENTION

Objects of the present invention involve providing a casting mold with a feeder which is less costly than conventional casting molds with feeders and which permits simpler and more propitious measurements of temperatures.

A casting mold with a feeder, particularly for an iron casting, comprises a lower mold part with a cavity for forming a casting, and an upper mold part coupled to the lower mold part. An exothermically heated feeder mass is located in the upper mold part and has an elongated hollow feeder volume in direct fluid communication with the cavity. The feeder volume corresponds to the amount of casting material which will be drawn into the cavity to compensate for casting shrinkage, plus a maximum security allowance of about 30 percent of the amount. The mass has an external configuration substantially in the shape of a sphere, ellipsoid or pear with a flattened portion adjacent the cavity and a smallest transverse diameter portion remote from the cavity. The transverse diameters are measured perpendicular to the longitudinal axis of the feeder volume to determine the smallest transverse diameter portion.

The propitious structure for measurement of temperatures is obtained by the favorable ratio of the feeder mass surface area to its feeder volume. On account of the relatively small surface area of the feeder mass relative to its hollow area or feeder volume, the energy created during the exothermic reaction is transferred more slowly to the structural material forming the mold and surrounding the feeder, as compared to conventional casting molds. Because the feeder mass is flattened, its center of gravity or inertia is closer to the casting or casting cavity than, to the side of the feeder mass remote from the casting. This is especially the case if the outer configuration of the feeder mass is generally pear-shaped. When the level of casting material in the feed volume drops, the energy supplied from the feeder mass is transmitted to the remaining amount of casting material found in the feeder column. The heat capacity of the feeder mass is completely used. The domed outside shape of the feeder mass of the present invention saves exothermically heated material, as compared with conventional feeder mass shapes. The mold material can be shaped and compressed around the feeder inlet in one processing step.

According to particularly preferred embodiments of the present invention, the ratio of the feeder mass wall thickness at its largest diameter to the feeder volume mean diameter is between about 0.5 and about 2.0, especially about 1.0, and the ratio of the feeder mass wall thickness at its flattened portion to the feeder volume mean diameter is between about 0.3 and about 1.0, especially about 0.8.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS

Figure 1:
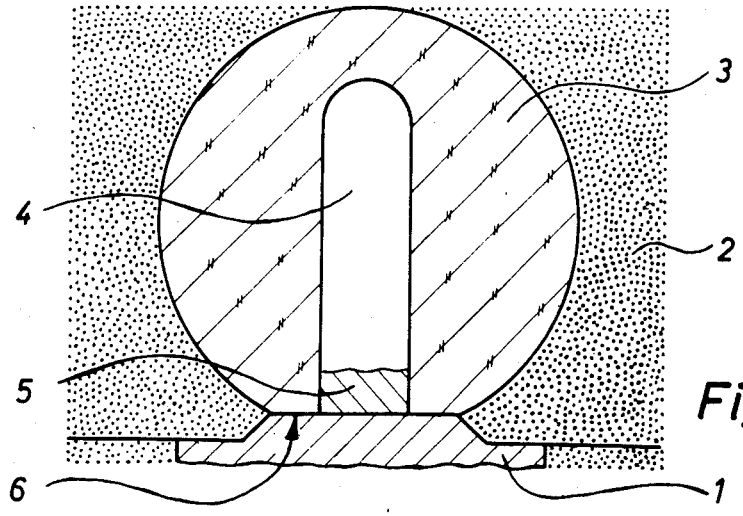
FIG. 1 is a partial side elevational view in section of a casting mold with a feeder according to a first embodiment of the present invention.

Referring to FIG. 1, a casting 1 is formed in a sand mold 2 comprising an upper mold part or cope and a lower mold part or drag. The upper mold part or cope includes an exothermically heated feeder mass 3. Feeder mass 3 is surrounded on its outside surface by an asbestos paper sheathing.

Feeder mass 3 defines an elongated area 4 forming a feeder volume, which feeder volume corresponds to the amount of casting material drawn in the mold cavity, in which the casting is formed, by suction to compensate for casting shrinkage, plus a small additional quantity (about 30 percent) of cast iron forming a flash 5. An interface 6 is at the flattened portion or bottom of feeder mass 3, at which point the flash 5 is separated from casting 1.

Feeder mass 3 has dimensions such that the quantity of heat released from the exothermically heated mass maintains the casting material in hollow area 4 in a liquid state until termination of the drawing in of casting material by suction to casting 1. During the drawing in by suction process, the casting material level in the feeder volume drops in response to the suction capacity and need of the casting.

Hollow area 4 forming the feeder volume is cylindrical, or slightly conical with a larger opening adjacent to casting 1. Feeder mass 3 is in the shape of a globe or sphere with a flatten portion or planar surface in the area of interface 6.

Figure 2:
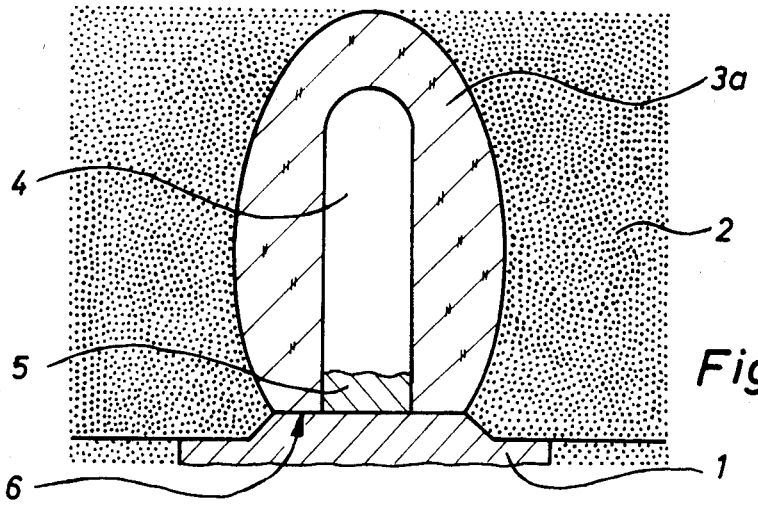
FIG. 2 is a partial side elevational view in section of a casting mold with a feeder according to a second embodiment of the present invention.
Figure 3:
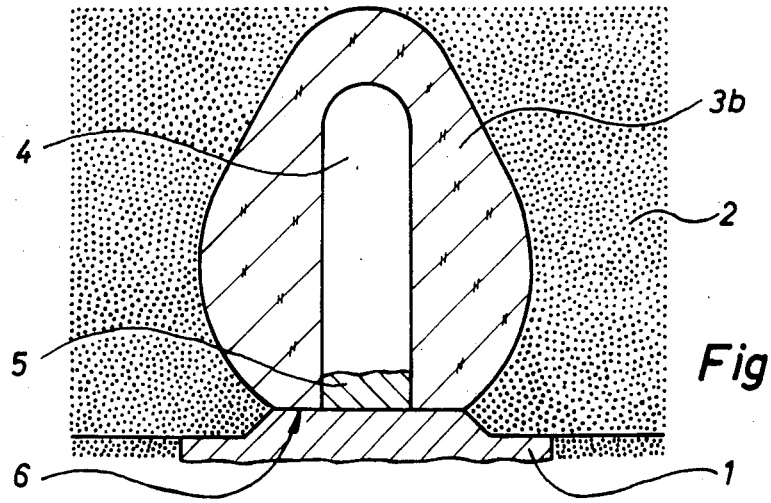
FIG. 3 is a partial side elevational view in section of a casting mold with a feeder according to a third embodiment of the present invention.

In the embodiments of FIGS. 2 and 3, the same parts are referred to with the same numbers. Parts which are modified, as compared with the first embodiment, are identified with a number having an "a" or "b" suffix.

In FIG. 2, feeder mass 3*a* is externally configured as an ellipsoid. In FIG. 3, the outside shape of feeder mass 3*b* is generally in the shape of a pear or an ice cream cone. The thick area in each embodiment is adjacent to casting 1 and interface 6, and forms the flattened portion or planar surface.

The proportional relationship of the wall thickness of feeder mass 3, 3*a* or 3*b* at the thickest part of its wall to the mean inside transverse diameter of hollow area 4 of the feeder volume, is between about 0.5 and about 2.0, and preferably about 1.0. In The area of the base of hollow area 4 forming the feeder volume at interface 6, the wall thickness to feeder volume mean transverse diameter ratio is between about 0.3 and about 1.0, and preferrably about 0.8.

While various embodiments have been chosen to illustrate the invention, it will be understood by those skilled in the art that various changes and modifications can be made therein without departing from the scope of the invention as defined in the appended claims.

What is claimed is:

1. A casting mold with a feeder, particularly for an iron casting, comprising:

a lower mold part with a cavity for forming a casting;

an upper mold part coupled to said lower mold part; and an exothermically heated mass embedded in said upper mold part having an elongated hollow feeder volume therein in direct fluid communication with said cavity, said feeder volume extending along an axis and corresponding to an amount of casting material which will be drawn into said cavity to compensate for casting shrinkage plus a maximum security allowance of about 30 percent of said amount, said mass having a varying wall thickness, an internal surface directly abutting and defining said feeder volume and an external configuration substantially in the shape of a sphere with a flattened portion, said sphere having a smallest transverse diameter portion remote from said cavity for diameters transverse to said axis, said flattened portion being adjacent said cavity such that said mass has a center of gravity closer to said cavity than to a side of said mass remote from said cavity;

said mass having a first wall thickness at a thickest portion thereof and a second wall thickness at said flattened portion, and said feeder volume having a mean diameter, a first ratio of said first wall thickness to said mean diameter being between about 0.5 and about 2.0, a second ratio of said second wall thickness to said mean diameter being about 0.3 and about 1.0.

2. A casting mold according to claim 1 wherein said feeder volume is cylindrical.

3. A casting mold according to claim 1 wherein said feeder volume is conical and tapers slightly in a direction away from said cavity.

4. A casting according to claim 1 wherein said first ratio is about 1.0.

5. A casting according to claim 1 wherein said second ratio is about 0.8.

6. A casting mold with a feeder, particularly for an iron casting, comprising:

a lower mold part with a cavity for forming a casting;

an upper mold part coupled to said lower mold part; and an exothermically heated mass embedded in said upper mold part having an elongated hollow feeder volume therein in direct fluid communication with said cavity, said feeder volume extending along an axis and corresponding to an amount of casting material which will be drawn into said cavity to compensate for casting shrinkage plus a maximum security allowance of about 30 percent of said amount, said mass having a varying wall thickness, an internal surface directly abutting and defining said feeder volume and an external configuration substantially in the shape of an ellipsoid with a flattened portion, said ellipsoid having a smallest transverse diameter portion remote from said cavity for diameters transverse to said axis, said flattened portion being adjacent said cavity such that said mass has a center of gravity closer to said cavity than to a side of said mass remote from said cavity;

said mass has a first wall thickness at a thickest portion thereof and a second wall thickness at said flattened portion, and said feeder volume having a mean diameter, a first ratio of said first wall thickness to said mean diameter being between about 0.5 and about 2.0, a second ratio of said second wall thickness to said mean diameter being about 0.3 and about 1.0.

7. A casting mold according to claim 6 wherein said feeder volume is cylindrical.

8. A casting mold according to claim 6 wherein said feeder volume is conical and tapers slightly in a direction away from said cavity.

9. A casting according to claim 6 wherein said first ratio is about 1.0.

10. A casting according to claim 6 wherein said second ratio is about 0.8.

11. A casting mold with a feeder, particularly for an iron casting, comprising:

a lower mold part with a cavity for forming a casting;

an upper mold part coupled to said lower mold part; and an exothermically heated mass embedded in said upper mold part having an elongated hollow feeder volume therein in direct fluid communication with said cavity, said feeder volume extending along an axis and corresponding to an amount of casting material which will be drawn into said cavity to compensate for casting shrinkage plus a maximum security allowance of about 30 percent of said amount, said mass having a varying wall thickness, an internal surface directly abutting and defining said feeder volume and an external configuration substantially in the shape of a pear with a flattened portion, said pear having a smallest transverse diameter portion remote from said cavity for diameters transverse to said axis, said flattened portion being adjacent said cavity such that said mass has a center of gravity closer to said cavity than to a side of said mass remote from said cavity;

said mass has a first wall thickness at a thickest portion thereof and a second wall thickness at said flattened portion, and said feeder volume having a mean diameter, a first ratio of said first wall thickness to said mean diameter being between about 0.5 and about 2.0, a second ratio of said second wall thickness to said mean diameter being about 0.3 and about 1.0.

12. A casting mold according to claim 11 wherein said feeder volume is cylindrical.

13. A casting mold according to claim 11 wherein said feeder volume is conical and tapers slightly in a direction away from said cavity.

14. A casting according to claim 11 wherein said first ratio is about 1.0.

15. A casting according to claim 11 wherein said second ratio is about 0.8.

* * * * *